United States Patent [19]

Kobayashi et al.

[11] Patent Number: 4,481,153

[45] Date of Patent: Nov. 6, 1984

[54] ROTARY THROTTLE VALVE CARBURETOR

[75] Inventors: Hiroto Kobayashi; Takeshi Kobayashi, both of Kawasaki, Japan

[73] Assignee: Walbro Far East, Inc., Kawasaki, Japan

[21] Appl. No.: 447,111

[22] Filed: Dec. 6, 1982

[30] Foreign Application Priority Data

Dec. 18, 1981 [JP] Japan ..... 56-187864[U]

[51] Int. Cl.[3] ..... F02M 9/08

[52] U.S. Cl. ..... 261/44 A; 261/44 G

[58] Field of Search ..... 261/44 G, 44 A, 44 D; 251/162

[56] References Cited

U.S. PATENT DOCUMENTS

| | | | |
|---|---|---|---|
| 883,740 | 4/1908 | Poppe | 261/44 A |
| 890,099 | 6/1908 | Richardson | 261/44 D |
| 1,120,845 | 12/1914 | Parkin | 261/44 G |
| 1,631,166 | 6/1927 | Spragne | 251/162 |
| 2,529,544 | 11/1950 | Ebert | 251/162 |
| 2,594,344 | 4/1952 | Pothier | 261/44 A |
| 3,943,207 | 3/1976 | Harootian | 261/44 A |
| 4,369,149 | 1/1983 | Violett | 261/44 G |

FOREIGN PATENT DOCUMENTS

| | | | |
|---|---|---|---|
| 625006 | 1/1927 | France | 261/44 A |
| 360020 | 11/1931 | United Kingdom | 261/44 A |

*Primary Examiner*—Tim Miles

*Attorney, Agent, or Firm*—Barnes, Kisselle, Raisch, Choate, Whittemore & Hulbert

[57] ABSTRACT

A rotary throttle valve carburetor in which the rotary valve is assembled with an operating lever, a needle valve and a carburetor body cover in such a way that the lever may be operated from opposite sides of the carburetor by orienting the assembly in the carburetor body in one of two positions 180° apart. A cam is interposed between the operating lever and the cover to shift the rotary valve and the needle valve axially with rotation of the valves to regulate the needle valve relative to a fuel nozzle port.

2 Claims, 4 Drawing Figures

ROTARY THROTTLE VALVE CARBURETOR

FIELD OF INVENTION

This design relates to a rotary throttle valve carburetor for use with portable small engines to power chain saws, weed cutters and the like.

BACKGROUND OF INVENTION

With reference to power machines controlled by an operator, the carburetor, depending on the kind of engine on which the carburetor is mounted, is arranged on the right side of the engine, or the left side of the engine in a position 180 degrees turned from the position on the right. However, the carburetor is generally controlled with a throttle lever. Therefore, depending on whether the carburetor is arranged to the right side of the engine, or to the left side of the engine with the position 180 degrees turned therefrom, the operating wire, which is extended from an operator's hand control lever to the throttle lever, sometimes works in a direction opposite to the movement of the throttle lever operation direction.

In cases where the operating wire tension direction works in reverse to the throttle lever operating direction, in the prior art, means for changing the energy direction 180 degrees, such as a link device, was utilized, thus complicating the control system. Accordingly, it is an object of the present invention to provide a rotary throttle valve carburetor which can be adapted to the throttle lever operating direction regardless of the right or left position of the carburetor body without the need of a direction change linkage.

Briefly, the present invention includes a carburetor with a rotary throttle valve which is provided with a cam device, to govern the axial position of the throttle, the cam being installed in between a cover on the carburetor body and the throttle lever. The throttle lever has a connection point for an operating cable or wire. The design of the throttle, the lever, the cover, and the cam make it possible to rotate the moving assembly 180° and thus change the direction in which an operating cable can approach the assembly relative to the carburetor body.

The objects of this design will be further made clear by the description given below, taken in connection with accompanying drawings illustrating, by way of example, a preferred embodiment of this design.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
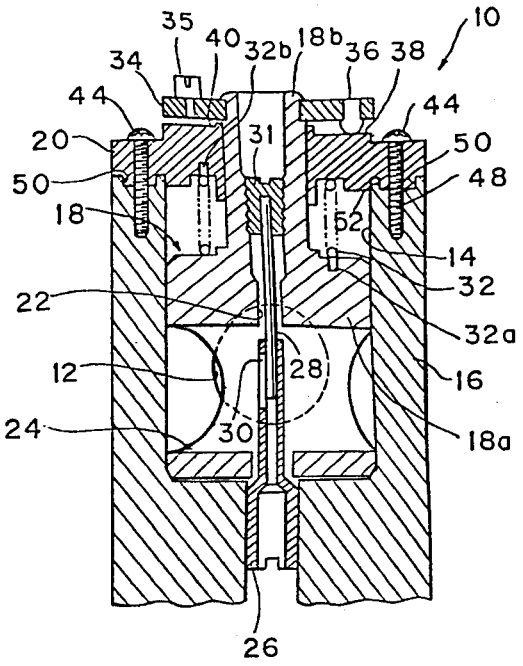
FIG. 1, a vertical section view showing the carburetor of this invention.

The carburetor 10 of this design, as shown in FIG. 1, comprises the carburetor body 16 having an air hole 12 or mixing passage, both ends of which open to a bore 14. A rotary throttle valve 18 is disposed in the bore 14.

The carburetor body 16 at one end of the air hole 12 is to be mounted on an engine to connect the air inlet of the carburetor (See FIG. 3) for instance to a two-cycle engine 17. The other end of the air hole 12 is connected with an air cleaner, not shown in a figure.

The rotary throttle valve 18 in the cylindrical portion 18*a* is provided with a cylindrical air passage 24 extending across the bore 14 and has a smaller extension 18*b* on the axis of rotation of the valve extended outward of the carburetor 16. This extension 18*b* passes through a cover 20 which mounts on the carburetor body 16 to close the open end of the bore 14. In throttle bore 14 the cylinder 18*a* is rotatably disposed on its axis of rotation and the throttle valve has a center hole 22 on the axis. In the throttle valve cylinder 18*a*, a throttle hole 24 is provided extending across the valve and adjustable with respect to the air hole 12. The cover 20 permits the throttle valve 18 to rotate about its center axis in the bore 14.

In the center hole 22 of the throttle valve 18 a nozzle tube 26, together with a needle 28, are mounted on the center axis of the throttle valve 18. One end of the nozzle tube 26 is fixed in the carburetor body 16 and the other end extends into the throttle hole 24 of the throttle valve 18. One end of the nozzle tube 26, as has been well known, connects to a fuel supply passage, extended from a constant pressure diaphragm chamber (not shown). Fuel from the supply passage will pass into the throttle bore 24 from a nozzle hole 30 on the circumference of the tube 26 close to the upper end.

A needle 28 on the axis of rotation of the said throttle valve 18 is mounted by way of the screw 31 which allows adjustment along the center axis. The other end of the needle 28 is extended into the nozzle tube 26 through the upper end. Accordingly, changing the axial position of the throttle valve 18, which supports the needle 28, in the direction of the center axis, will alter the relationship to the nozzle hole 30 which will be increased or decreased depending on the direction of the movement of the throttle valve.

A coil spring 32 encircling the extension 18*b* is disposed between the cover 20 on the body 16 and the top of the cylindrical portion 18*a* of the throttle valve 18 to hold the valve in any adjusted position.

As seen in the drawings, one end of the coil spring 32 contacts the shoulder of the throttle valve 18 and one end 32*a* is fastened to the throttle valve 18. Also, the other end of the coil spring 32 contacts the underside of the cover 20 and its terminal end 32*a* is fastened to the cover 20. By its elasticity, the spring 32 biases the throttle valve 18 along its center axis and provides a circumferential bias. As a result, this spring force holds the throttle valve 18 in the idling position.

Figure 3A:
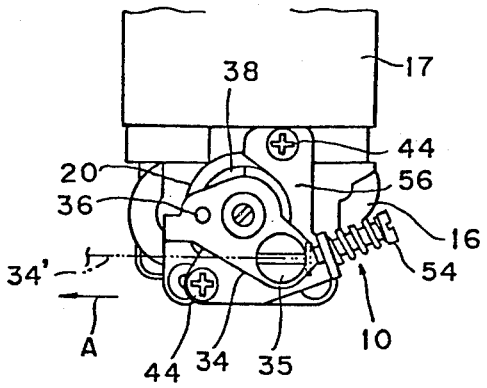
FIGS. 3(*a*) and 3(*b*) are plan views of the carburetor shown in FIG. 1 with controls reversed.
Figure 3B:
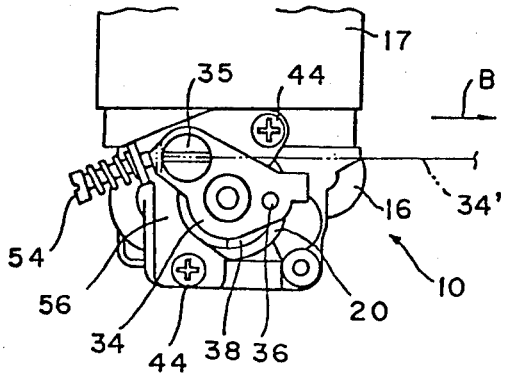

On the projecting end 18*b* of the throttle valve 18, a throttle lever 34 is fixed, and on the lever is a swivel 35 which is connected to an operating wire 34' (See FIGS. 3(*a*) and 3(*b*)). In between the throttle lever and the cover 20, a spiral cam device is provided which governs the axial position of the throttle valve 18 in relation to the rotation of the valve.

Figure 2:
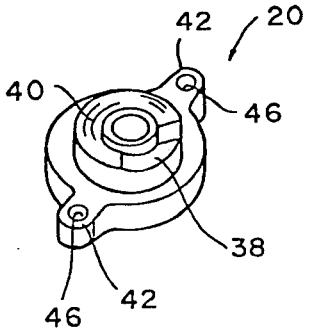
FIG. 2, a perspective view of the cover of the carburetor shown in FIG. 1.

The cam device cooperates with the throttle lever 34 and consists of a cam follower 36 on the lever which projects toward the cover 20. As shown in FIG. 2, the cover 20 has a cam face 38 in the form of an annular convex surface 40 inclined in its circumference.

On the cover 20 are lugs 42 extending outwardly from the surface 40 in diametric direction. Each of the lugs has a hole 46 for fastening screws 44 as shown in FIG. 1. The terminal end of body 16, as shown in FIG.

1, has screw holes 48 arranged to register with the holes 46. As shown in FIG. 1, an annular cavity 50 encircles each screw hole 48, and the cover 20 has projections 52 to fit in the respective cavities 50. Accordingly, by fitting both lugs 52 of the cover 20 into each cavity 50, the cover 20 is accurately positioned. By tightening the screws 44 into the screw holes 48, the cover 20 is secured.

As the throttle lever 34 is rotated by the operating cable or wire 34' (See FIGS. 3(*a*) and 3(*b*)), secured to swivel 35, the throttle valve 18, together with the throttle lever 34, move toward the full open position where the throttle bore 24 registers with the air hole 12. At the same time, the rotation of the throttle valve 18 causes the cam follower 36 on the throttle lever 34 to move on the face 40 of the cam 38. Consequently, the throttle valve 18, together with the said throttle lever 34 and the needle 28, all will move axially as a result of the cam motion of the throttle valve 18. Accordingly, the effective diameter of the nozzle hole 30 increases or decreases in relation to the angle of movement of the throttle valve.

The function of the throttle valve, in relation to the carburetor body and the cam action above described, will not be affected if the entire rotating assembly is turned 180° about the axis of the throttle valve 18. Thus, the throttle valve 18, the cover 20, and/or both of them and each part 28, 31, 32, 34, 35, 36 and 38, can be arranged in a 180° turn with respect to the carburetor body. The diametrical positioning of the holes 46 and 48 make it possible readily to rotate the entire movable assembly 180° with respect to the body.

Consequently, after taking off the screws 44 and turning the assembly of the throttle valve 18, the cover 20 and each of the said parts 28, 31, 32, 34, 35, 36 and 38 all in one body 180 degrees relative to the carburetor body around the axis of rotation of the rotary throttle valve 18, the cover can again be affixed to the carburetor body with the screws 44. By this means, the position of the throttle valve 18 relative to the body can be turned 180 degrees.

As a consequence, the cable swivel 35 to be connected to the operating cable or wire can be connected to a cable coming from a direction 180° away from the initial position. This is shown in FIGS. 3(*a*) and 3(*b*) where the tension direction of the operating wire 34, which is connected with the swivel 35, is in the direction of arrow A in FIG. 3(*a*) to the left, and in the direction of the arrow B to the right in FIG. 3(*b*).

In FIGS. 3(*a*) and 3(*b*), the bracket 56 is shown which supports the idle adjusting screw 54 for adjusting the idling position of the throttle lever 34 as has been well known. Bracket 56 is mounted on the cover 20 with one of the screws 44.

According to this design, as has been described above, by turning around the position of the throttle valve 18, the cover 20 etc. simply by loosening of the screws 44, and then tightening the screws 44 again, it makes it possible to operate the throttle lever from directions 180° opposed to each other.

Therefore, regardless of the position of the carburetor on an engine, the direction of the operation of the throttle lever can be easily adapted without the need of a reverse direction link system. Thereby, the control of the engine is readily accomplished without the complication of linkage.

What is claimed is:

1. In a rotary throttle type carburetor in which a rotary throttle is positioned in a bore transverse to an air passage in a carburetor body with a throttle passage registering with said air passage and a fuel nozzle extending into said throttle passage, and including a needle control valve mounted centrally of said rotary throttle and extending into said fuel nozzle, that improvement in which a cover plate is positioned on said carburetor body to close said bore, said rotary throttle having a stem extending through said cover plate, an annular cam surface on the exposed surface of said cover plate, a cam follower externally of said cover plate extending radially outward of said stem in axial contact with said cam surface, spring means between said cover plate and said throttle to maintain said cam follower in contact with said cam surface, whereby rotating of said rotary throttle will cause an axial adjustment of said needle control valve relative to said fuel nozzle.

2. A carburetor as defined in claim 1 in which an operating lever is provided on said stem and said cover plate is applicable to said carburetor body selectively in one of two positions 180° apart in orientation, whereby the lever may be operated selectively from one of two opposed directions.

* * * * *

UNITED STATES PATENT AND TRADEMARK OFFICE

CERTIFICATE OF CORRECTION

PATENT NO. : 4,481,153

DATED : November 6, 1984

INVENTOR(S) : Kobayashi et al

It is certified that error appears in the above-identified patent and that said Letters Patent are hereby corrected as shown below:

Delete the named inventor Hiroto Kobayashi and substitute therefor TERUHIKO TOBINAI so that the inventors should read TAKESHI KOBAYASHI and TERUHIKO TOBINAI.

Signed and Sealed this

*Twenty-ninth* Day of *January 1985*

[SEAL]

*Attest:*

DONALD J. QUIGG

*Attesting Officer* *Acting Commissioner of Patents and Trademarks*